US008031126B2

(12) United States Patent
Cunningham

(10) Patent No.: US 8,031,126 B2
(45) Date of Patent: Oct. 4, 2011

(54) DUAL POLARIZED ANTENNA

(75) Inventor: Patrick W. Cunningham, McKinney, TX (US)

(73) Assignee: Raytheon Company, Waltham, MA (US)

( * ) Notice: Subject to any disclaimer, the term of this patent is extended or adjusted under 35 U.S.C. 154(b) by 953 days.

(21) Appl. No.: 11/939,300

(22) Filed: Nov. 13, 2007

(65) Prior Publication Data

US 2009/0121967 A1 May 14, 2009

(51) Int. Cl.
*H01Q 13/10* (2006.01)

(52) U.S. Cl. ..... 343/770; 343/767

(58) Field of Classification Search ..... 343/767, 343/770, 771, 772, 893, 908
See application file for complete search history.

(56) References Cited

U.S. PATENT DOCUMENTS

| | | | | |
|---|---|---|---|---|
| 2,480,182 | A | 8/1949 | Clapp | |
| 4,978,965 | A * | 12/1990 | Mohuchy | 343/727 |
| 5,068,671 | A | 11/1991 | Wicks | |
| 5,070,339 | A | 12/1991 | Chu et al. | |
| 5,461,392 | A | 10/1995 | Mott et al. | |
| 6,344,830 | B1 | 2/2002 | Taylor | |
| 7,348,933 | B2 * | 3/2008 | Nilsson | 343/895 |
| 2002/0118138 | A1 | 8/2002 | Lindenmeier et al. | |
| 2003/0210197 | A1 | 11/2003 | Cencich et al. | |
| 2004/0004580 | A1 | 1/2004 | Toland et al. | |

FOREIGN PATENT DOCUMENTS

| | | |
|---|---|---|
| EP | 0 227 121 | 7/1987 |

OTHER PUBLICATIONS

PCT Notification of Transmittal of the International Search Report and the Written Opinion of the International Searching Authority, or the Declaration, regarding PCT Application No. US2008/080587 (14 pages).

* cited by examiner

*Primary Examiner* — Jacob Y Choi
*Assistant Examiner* — Robert Karacsony
(74) *Attorney, Agent, or Firm* — Baker Botts L.L.P.

(57) ABSTRACT

In one embodiment according to the teachings of the present disclosure, an antenna generally includes a first, second, and third elements. The first and second elements form a first electro-magnetic radiator that is operable to transmit or receive a first signal having a first sense of polarization. The first and third elements form a second electro-magnetic radiator that is operable to transmit or receive a second signal having a second sense of polarization that is different than the first sense of polarization.

25 Claims, 3 Drawing Sheets

DUAL POLARIZED ANTENNA

TECHNICAL FIELD OF THE DISCLOSURE

This disclosure relates generally to antennas, and more particularly, to a dual polarized antenna for generating dual polarized electro-magnetic signals.

BACKGROUND OF THE DISCLOSURE

Wireless communication, ranging, detection, and direction finding may be provided by transmission and reception of electro-magnetic signals at various frequencies throughout the radio-frequency (RF) spectrum. Electro-magnetic radiation may have characteristics that may enable selectivity of electro-magnetic signals based upon their polarization. To control the sense of polarization, dual polarized antennas have been developed. These dual polarized antennas generally include two electro-magnetic radiators that are oriented orthogonally relative to one another such that the antenna may transmit or receive microwave frequencies at virtually any polarization sense.

SUMMARY OF THE DISCLOSURE

In one embodiment according to the teachings of the present disclosure, an antenna generally includes a first, second, and third elements. The first and second elements form a first electro-magnetic radiator that is operable to transmit or receive a first signal having a first sense of polarization. The first and third elements form a second electro-magnetic radiator that is operable to transmit or receive a second signal having a second sense of polarization that is different than the first sense of polarization.

According to another embodiment, an antenna generally includes a first, second, third, and fourth elements that are disposed at oblique angles relative to one another around a boresight axis. The first and second elements are operable to transmit or receive a first signal having a first sense of polarization. The third and fourth elements are operable to transmit or receive a second signal having a second sense of polarization that is different than the first sense of polarization.

Some embodiments of the disclosure provide numerous technical advantages. A technical advantage of one embodiment of the present disclosure may include less physical structure for a given bandwidth of operation. Known dual polarized notch antennas may use four elements. The dual polarized antenna according to the teachings of the present disclosure may provide similar performance to, yet having less physical structure than these known dual polarized antenna designs by elimination of one of the four elements. The physical orientation of the three elements may also provide relatively good equalization of the electric (E) and magnetic (H) beamwidths of the electro-magnetic signal in some embodiments.

While specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS OF THE DISCLOSURE

A flared notch radiator is a common type electro-magnetic radiator used in the construction of dual polarized antennas. The flared notch antenna generally incorporates two opposing elements separated by a gap that flares or widens along its boresight axis. When energized by an electrical signal, the progressively increasing gap causes the electrical signal to be emitted as electro-magnetic radiation along the boresight axis. Known dual polarized antennas implemented with flared notch radiators generally include four elements comprising two elements for each of the two flared notch radiators. Although dual polarized antennas implemented with flared notch radiators do provide selective polarization, they are difficult to implement with a combination of relatively small physical structure.

Figure 1:
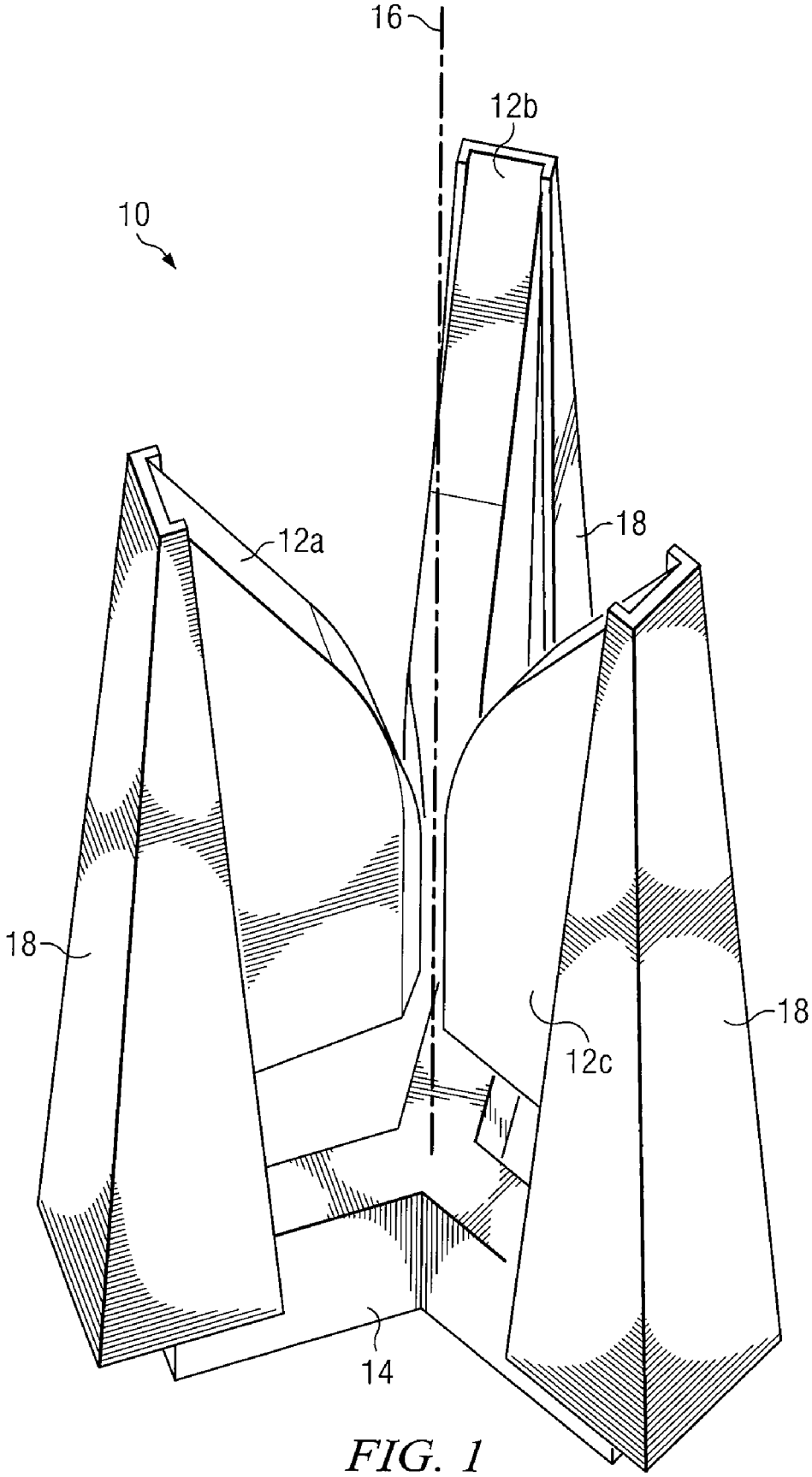
FIG. 1 is a perspective view of one embodiment of a dual polarized antenna according to the teachings of the present disclosure.

FIG. 1 shows one embodiment of a dual polarized antenna 10 according to the teachings of the present disclosure that may provide a solution to this problem as well as other problems. Dual polarized antenna 10 generally includes three elements 12*a*, 12*b*, and 12*c* that are held in fixed physical relation to each other with a Y-shaped structure 14. Element 12*a* and element 12*b* form a first flared notch radiator that is operable to transmit or receive a first electro-magnetic signal. Element 12*a* and element 12*c* form another flared notch radiator that is operable to transmit or receive another electro-magnetic signal with a sense of polarization that is different than the sense of polarization of the first electro-magnetic signal.

Dual polarized antenna 10 may provide dual polarized electro-magnetic signals with essentially three elements 12*a*, 12*b*, and 12*c*. Certain embodiments may provide an advantage over other known dual polarized antennas in that the relatively fewer quantity of elements may serve to reduce the overall physical structure of the dual polarized antenna 10. This reduction in overall physical structure may also enable each the elements 12*a*, 12*b*, and 12*c* to be relatively larger while maintaining comparable characteristics of other known four element flared notch antenna designs. For example, dual polarized antenna 10 may have a bandwidth of approximately 2 to 18 Giga-Hertz (GHz) while having an overall physical structure that is less than other known flared notch antennas having similar characteristics.

Dual polarized antenna 10 may also provide improved equalization of electric (E) plane beamwidth and magnetic (H) plane beamwidth in some embodiments. Known flared notch radiator designs typically produce electro-magnetic signals having a magnetic plane beamwidth that is relatively larger than its corresponding electric plane beamwidth. The dual polarized antenna 10 however, may provide enhanced the beamwidth symmetry of resulting electric plane beamwidths and magnetic plane beamwidths produced and/or may have improved operating efficiency in some embodiments.

Each of the elements 12*a*, 12*b*, and 12*c* may be aligned along a common boresight axis 16. The boresight axis 16 generally refers to a central axis from which electro-magnetic signals may be emitted by dual polarized antenna 10. By aligning elements 12*a*, 12*b*, and 12*c* along a common boresight axis 16, transmitted or received electro-magnetic signals may be combined at various phases and/or amplitudes relative to one another to form a resulting electro-magnetic signal having any desired polarization.

In one aspect of the present disclosure, elements 12*a* and 12*b* forming the first flared notch radiator are disposed at an oblique angle relative to one another around the boresight axis 16 and elements 12*a* and 12*c* forming the second flared notch radiator are disposed at another oblique angle relative to one another around the boresight axis 16. In this manner, electro-magnetic signals emanating from the first and second flared notch radiators may have a sense of polarization that are oblique to each other. This angular relationship may enable combining of electro-magnetic signals with differing phases and/or amplitudes from both flared notch radiators in order to form a single resultant electro-magnetic signal having any desired polarization. In the particular embodiment shown, the first and second flared notch radiators are implemented with a common element 12*a*; it should be appreciated, however, that first and second flared notch radiators may each have individual elements 12 that are electrically and/or magnetically isolated from each other.

In one embodiment, absorptive gloves 18 may be provided on the outer portion of each of the element 12*a*, 12*b*, and 12*c*. Absorptive gloves 18 may be configured to enhance an impedance match of the elements 12*a*, 12*b*, and 12*c* over the frequency range of operation. Absorptive gloves may be formed of any suitable material that absorbs electro-magnetic radiation. This absorptive material may include small fragments of ferrous-based compounds that are capable of absorbing electric and/or magnetic energy.

Figure 2:
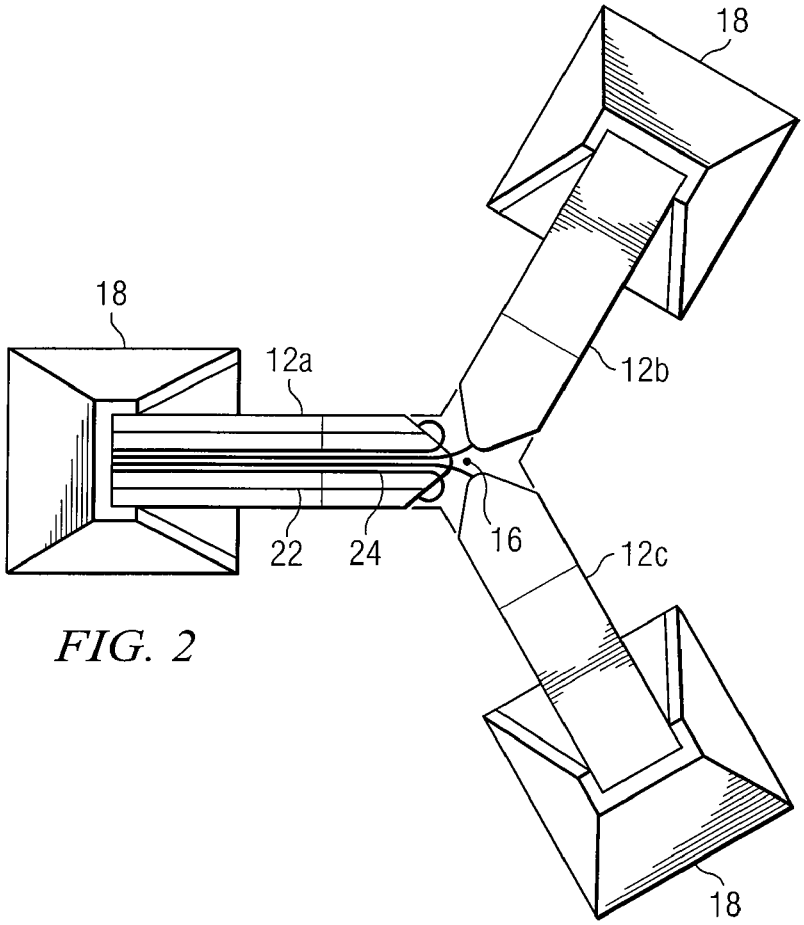
FIG. 2 is a plan view of the dual polarized antenna of FIG. 1 as seen from its boresight axis.

FIG. 2 is a plan view of the dual polarized antenna 10 of FIG. 1 as seen from its boresight axis 16. In this particular embodiment, elements 12*a*, 12*b*, and 12*c* are each disposed approximately 120 degrees apart around the boresight axis 16. It should be understood, however, that various angular configurations of elements 12 around boresight axis 16 may be implemented. A pair of transmission lines 24 may be provided for coupling of the elements 12*a*, 12*b*, and 12*c* to an external source. In one embodiment, the pair of transmission lines 24 may each be disposed in a cavity 22 in element 12*a*. The flared notch radiator formed by elements 12*a* and 12*b* may be coupled to one transmission line 24 and flared notch radiator formed by elements 12*a* and 12*c* may be coupled to the other transmission line 24. In one embodiment, transmission lines 24 are coaxial cables.

Dual polarized antenna 10 may be independently driven by each of the transmission lines 24 to produce a resultant electro-magnetic signal having any desired polarization. In one embodiment, one transmission line 24 may be driven with a signal having a particular phase and amplitude relative to the other transmission line 24 such that the resultant electro-magnetic polarization produced by each is orthogonal to one another. That is, the sense of polarization of an electro-magnetic signal produced by elements 12*a* and 12*b* may be orthogonal to the sense of polarization of an electro-magnetic signal produced by elements 12*a* and 12*c*.

Figure 3A:
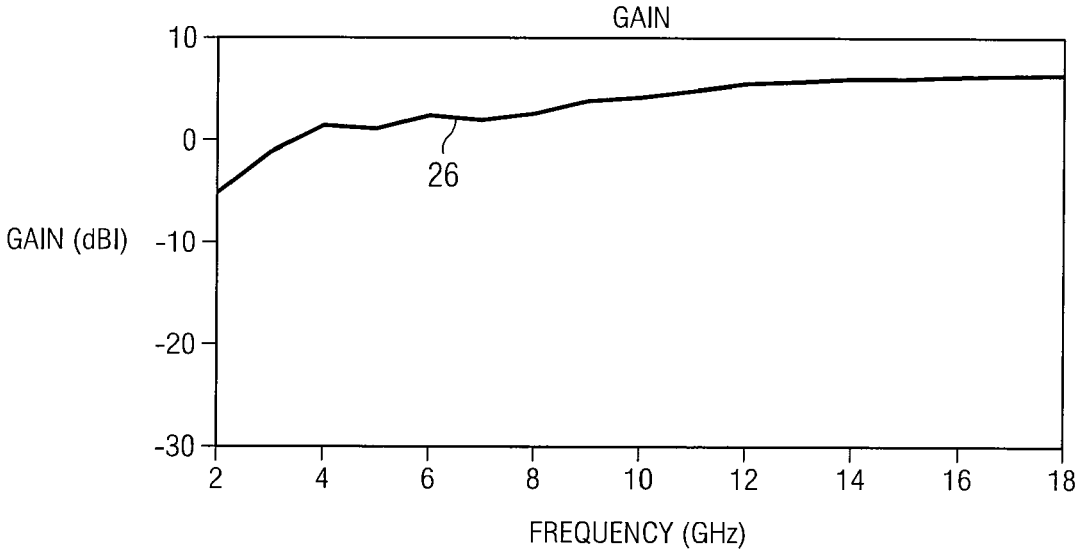
FIG. 3A is a graph showing a gain plot from an electro-magnetic model simulation that was performed on the embodiment of FIG. 1.
Figure 3B:
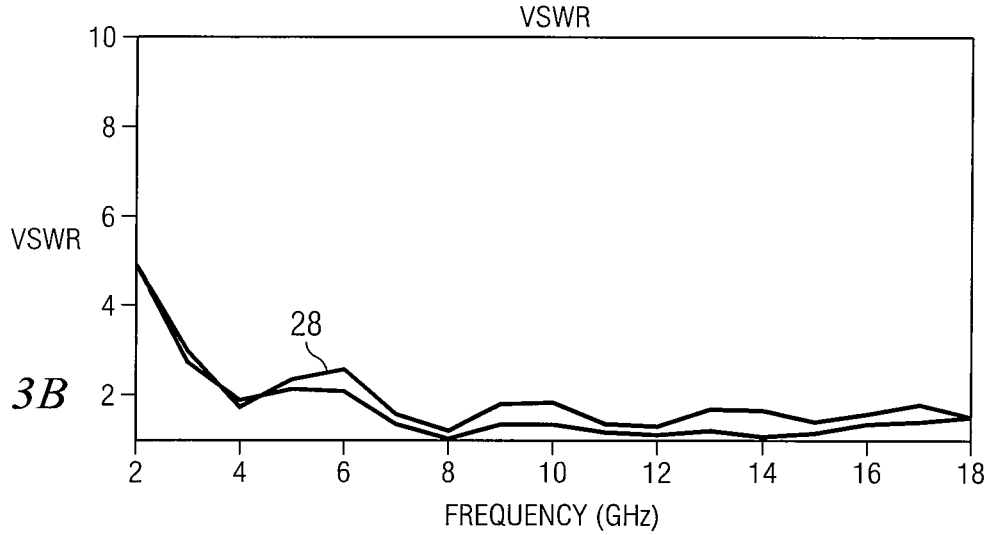
FIG. 3B is a graph showing a voltage standing wave ratio plot from an electro-magnetic model simulation that was performed on the embodiment of FIG. 1.

FIGS. 3A and 3B are graphs showing a relative gain plot 28 and a voltage standing wave ratio (VSWR) plot 28, respectively, of computer simulations that were performed on the dual polarized antenna 10 according to the teachings of the present disclosure. The particular gain plot 26 and voltage standing wave ratio plot 28 were generated by executable software, such as CST Microwave Studio™, available from Computer Simulation Technology (CST) GmbH, located in Darmstadt, Germany. As can be seen, the dual polarized antenna 10 may have a relatively flat gain and a relatively low voltage standing wave ratio characteristics when operating at a frequency range from 2 to 18 Giga-Hertz.

Figure 4A:
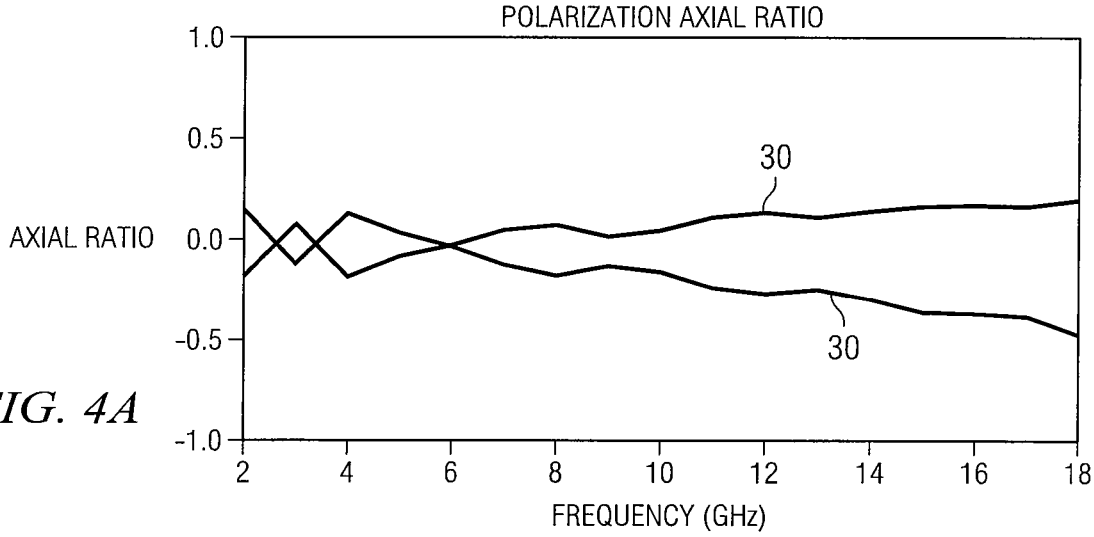
FIG. 4A is a graph showing a polarization axial ratio plot of a simulation that was performed on the embodiment of FIG. 1.
Figure 4B:
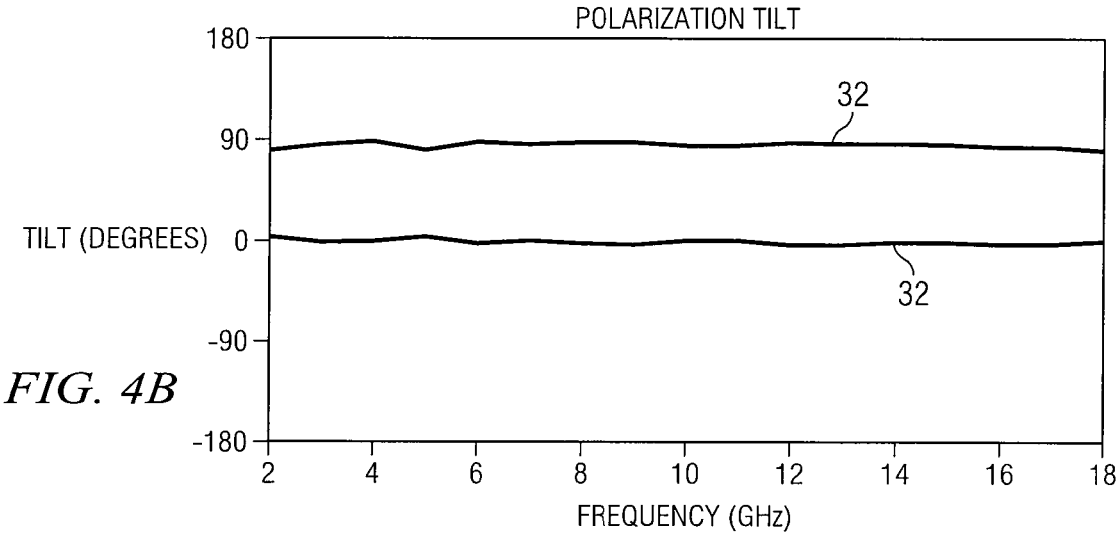
FIG. 4B is a graph showing a polarization tilt plot of a simulation that was performed on the embodiment of FIG. 1.

FIGS. 4A and 4B are graphs showing a polarization axial ratio plot 30 and a polarization tilt plot 32, respectively, of computer simulations performed on the dual polarized antenna 10. As can be seen, the predicted orthogonality between the flared notch radiator formed by elements 12*a* and 12*b* and flared notch radiator formed by elements 12*a* and 12*c* may be relatively good.

A dual polarized antenna 10 has been described that may provide relatively good orthogonality with a relatively smaller physical structure than other known flared notch antenna designs. In one embodiment, these features may be provided by elements 12 that are disposed at oblique angles relative to one another around its boresight axis 16. In another embodiment, these feature may be provided by essentially three elements 12 in which one of the elements 12*a* may serve as a common element for the other two elements 12*b* and 12*c*. The three elements 12 may be relatively smaller in physical structure than other known dual polarized antennas having four elements. Additionally, the physical orientation of the three elements 12 may also provide relatively good equalization of the electric (E) and magnetic (H) beamwidths of the electro-magnetic signal.

It will be apparent that many modifications and variations may be made to embodiments of the present disclosure, as set forth above, without departing substantially from the principles of the present disclosure. Therefore, all such modifications and variations are intended to be included herein within the scope of the present disclosure, as defined in the claims that follow.

What is claimed is:

1. An antenna comprising:

a first element and a second element forming a first flared notch radiator that is operable to transmit or receive a first signal along a boresight axis having a first sense of polarization, the first element being approximately 120 degrees apart from the second element around the boresight axis; and a third element and the first element forming a second flared notch radiator that is operable to transmit or receive a second signal along the boresight axis having a second sense of polarization that is orthogonal to the first sense of polarization, the first element being approximately 120 degrees apart from the third element around the boresight axis.

2. The antenna of claim 1, wherein the first electro-magnetic radiator and the second electro-magnetic radiator have a bandwidth that is in the range of 2 to 18 Giga-Hertz.

3. An antenna comprising:

a first element and a second element, the first element being approximately 120 degrees apart from the second element around a boresight axis, forming a first electro-magnetic radiator that is operable to transmit or receive a first signal having a first sense of polarization; and a third element and the first element, the third element being approximately 120 degrees apart from the first element along the boresight axis, forming a second electro-magnetic radiator that is operable to transmit or receive a second signal having a second sense of polarization that is different than the first sense of polarization;

wherein the first, second and third element include electro-magnetic absorptive gloves disposed on an outer edge of each element.

4. The antenna of claim 3, wherein the first electro-magnetic radiator and the second electro-magnetic radiator are flared notch radiators.

5. The antenna of claim 3, wherein the first electro-magnetic radiator and the second electro-magnetic radiator have a bandwidth that is in the range of 2 to 18 Giga-Hertz.

6. The antenna of claim 3, wherein the first element and a second element are driven by a first transmission line, and the third element and the first element are driven by a second transmission line.

7. The antenna of claim 6, wherein the first transmission line and second transmission line are coaxial cable lines.

8. The antenna of claim 3, wherein the second sense of polarization is orthogonal to the first sense of polarization.

9. An antenna comprising:

a first element and a second element that are disposed at a first oblique angle relative to one another around a boresight axis, the first element and the second element forming a first electro-magnetic radiator that is operable to transmit or receive a first signal having a first sense of polarization; and a third element and the first element are disposed at a second oblique angle relative to one another around the boresight axis, the third element and the first element forming a second electro-magnetic radiator that is operable to transmit or receive a second signal having a second sense of polarization that is different than the first sense of polarization;

wherein the first, second and third elements further comprise electro-magnetic absorptive gloves disposed on an outer edge of each element.

10. The antenna of claim 9, wherein the first electro-magnetic radiator and the second electro-magnetic radiator are flared notch radiators.

11. The antenna of claim 9, wherein the first electro-magnetic radiator and the second electro-magnetic radiator have a bandwidth that is in the range of 2 to 18 Giga-Hertz.

12. The antenna of claim 9, wherein the first element and a second element are driven by a first transmission line, and the third element and the first element are driven by a second transmission line.

13. The antenna of claim 12, wherein the first transmission line and second transmission line are coaxial cable lines.

14. The antenna of claim 9, wherein the second sense of polarization is orthogonal to the first sense of polarization.

15. An antenna comprising:

a first element and a second element, the first element being approximately 120 degrees apart from the second element around a boresight axis, forming a first electro-magnetic radiator that is operable to transmit or receive a first signal having a first sense of polarization; and a third element and the first element, the third element being approximately 120 degrees apart from the first element along the boresight axis, forming a second electro-magnetic radiator that is operable to transmit or receive a second signal having a second sense of polarization that is different than the first sense of polarization;

wherein the first electro-magnetic radiator and the second electro-magnetic radiator are flared notch radiators.

16. The antenna of claim 15, wherein the first electro-magnetic radiator and the second electro-magnetic radiator have a bandwidth that is in the range of 2 to 18 Giga-Hertz.

17. The antenna of claim 15, wherein the first element and a second element are driven by a first transmission line, and the third element and the first element are driven by a second transmission line.

18. The antenna of claim 17, wherein the first transmission line and second transmission line are coaxial cable lines.

19. The antenna of claim 15, wherein the second sense of polarization is orthogonal to the first sense of polarization.

20. The antenna of claim 15, further comprising electro-magnetic absorptive gloves disposed on an outer edge of each of the first element, second element, and the third element.

21. An antenna comprising:

a first element and a second element that are disposed at a first oblique angle relative to one another around a boresight axis, the first element and the second element forming a first electro-magnetic radiator that is operable to transmit or receive a first signal having a first sense of polarization; and a third element and the first element are disposed at a second oblique angle relative to one another around the boresight axis, the third element and the first element forming a second electro-magnetic radiator that is operable to transmit or receive a second signal having a second sense of polarization that is different than the first sense of polarization;

wherein the first electro-magnetic radiator and the second electro-magnetic radiator are flared notch radiators.

22. The antenna of claim 21, wherein the first electro-magnetic radiator and the second electro-magnetic radiator have a bandwidth that is in the range of 2 to 18 Giga-Hertz.

23. The antenna of claim 21, wherein the first element and a second element are driven by a first transmission line, and the third element and the first element are driven by a second transmission line.

24. The antenna of claim 23, wherein the first transmission line and second transmission line are coaxial cable lines.

25. The antenna of claim 21, wherein the second sense of polarization is orthogonal to the first sense of polarization.

* * * * *